US006465140B1

(12) United States Patent
Majumdar et al.

(10) Patent No.: US 6,465,140 B1
(45) Date of Patent: Oct. 15, 2002

(54) METHOD OF ADJUSTING CONDUCTIVITY AFTER PROCESSING OF PHOTOGRAPHS

(75) Inventors: Debasis Majumdar, Rochester; Thomas M. Laney, Spencerport; Jehuda Greener, Rochester; Peter T. Aylward, Hilton; Gary S. Freedman, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/853,515

(22) Filed: May 11, 2001

(51) Int. Cl.[7] ..... G03C 5/00; G03C 7/00
(52) U.S. Cl. ..... 430/30; 430/527
(58) Field of Search ..... 430/30, 527

(56) References Cited

U.S. PATENT DOCUMENTS

| | | | | | |
|---|---|---|---|---|---|
| 4,186,891 | A | | 2/1980 | Johnson | 242/55.19 R |
| 4,208,018 | A | | 6/1980 | Wilkinson | 242/55.19 R |
| 4,275,103 | A | | 6/1981 | Tsubusaki et al. | 428/148 |
| 4,394,441 | A | | 7/1983 | Kawaguchi et al. | 430/524 |
| 4,416,963 | A | | 11/1983 | Takimoto et al. | 430/69 |
| 4,418,141 | A | | 11/1983 | Kawaguchi et al. | 430/530 |
| 4,431,764 | A | | 2/1984 | Yoshizumi | 524/409 |
| 4,495,276 | A | | 1/1985 | Takimoto et al. | 430/527 |
| 4,571,361 | A | | 2/1986 | Kawaguchi et al. | 428/328 |
| 4,999,276 | A | | 3/1991 | Kuwabara et al. | 430/264 |
| 5,122,445 | A | | 6/1992 | Ishigaki | 430/523 |
| 5,190,698 | A | * | 3/1993 | Coltrain et al. | 252/518 |
| 5,294,525 | A | | 3/1994 | Yamauchi et al. | 430/523 |
| 5,340,676 | A | | 8/1994 | Anderson et al. | 430/63 |
| 5,368,995 | A | | 11/1994 | Christian et al. | 430/530 |
| 5,382,494 | A | | 1/1995 | Kudo et al. | 430/140 |
| 5,459,021 | A | | 10/1995 | Ito et al. | 430/527 |
| 5,466,567 | A | | 11/1995 | Anderson et al. | 430/530 |
| 5,484,694 | A | | 1/1996 | Lelental et al. | 430/530 |
| 5,679,505 | A | | 10/1997 | Tingler et al. | 430/523 |
| 5,700,623 | A | | 12/1997 | Anderson et al. | 430/256 |
| 6,140,030 | A | | 10/2000 | Anderson et al. | 430/529 |
| 6,197,486 | B1 | * | 3/2001 | Majundar et al. | 430/527 |

FOREIGN PATENT DOCUMENTS

| | | |
|---|---|---|
| JP | 04-055492 | 2/1992 |

* cited by examiner

*Primary Examiner*—Hoa Van Le
(74) *Attorney, Agent, or Firm*—Paul A. Leipold; Lynne M. Blank

(57) ABSTRACT

The invention relates to a method of conductivity control comprising providing a photographic element having a lower surface antistatic layer comprising polyether polymeric antistat, imaging said photographic element, processing said photographic element in aqueous development solutions, and recovering said developed photographic element, wherein the lower surface resistivity of said photographic element attains a value ≧10 log ohm/sq. but <13 log ohms/sq. after processing.

8 Claims, No Drawings

METHOD OF ADJUSTING CONDUCTIVITY AFTER PROCESSING OF PHOTOGRAPHS

FIELD OF THE INVENTION

This invention relates to a method of controlling electrical conductivity of photographic products. In particular, the invention relates to a method of adjusting the electrical conductivity of a photographic element before and after wet chemical processing.

BACKGROUND OF THE INVENTION

The problem of controlling electrostatic charge is well known in the field of photography. It is also generally known that electrostatic charge can usually be effectively controlled by incorporating an electrically-conductive "antistatic" layer into the film structure. An antistatic layer can be applied to either side of the film base as a subbing layer, that is, beneath the imaging layer or on the side opposite to the imaging layer. An antistatic layer can alternatively be applied as an outer coated layer either over the emulsion layers or on the side of the film base opposite to the emulsion layers (i.e., the backside of the film). For some applications, the antistatic agent can be incorporated into the emulsion layers. Alternatively, the antistatic agent can be directly incorporated into the film base itself Typically, however, the antistatic layer is employed on the backside of the film and frequently it underlies an abrasion resistant, protective topcoat.

A wide variety of electrically-conductive materials can be incorporated into antistatic layers to produce a wide range of conductivity. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. These antistatic layers generally exhibit a substantial loss of antistatic function as a result of exposure to photographic processing solutions. Antistatic layers containing electronic conductors such as conjugated conducting polymers, conducting carbon particles, crystalline semiconductor particles, amorphous semiconductive fibrils, and continuous semiconducting thin films can be used more effectively than ionic conductors to dissipate static charge since their electrical conductivity is independent of relative humidity and only slightly influenced by ambient temperature. The antistatic properties of such electronic conductors may or may not be affected by photographic processing depending on the particular material. Of the various types of electronic conductors, electrically conducting metal-containing particles, such as semiconducting metal oxides, are particularly effective when dispersed in suitable polymeric film-forming binders in combination with polymeric non-film-forming particles as described in U.S. Pat. Nos. 5,340,676; 5,466,567; 5,700,623. Binary metal oxides doped with appropriate donor heteroatoms or containing oxygen deficiencies have been disclosed in prior art to be useful in antistatic layers for photographic elements, for example, U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; 5,484,694 and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include antimony-doped tin oxide, fluorine-doped tin oxide, aluminum-doped zinc oxide, and niobium-doped titania. Additional preferred conductive ternary metal oxides disclosed in U.S. Pat. No. 5,368,995 include zinc antimonate and indium antimonate. Other conductive metal-containing granular particles including metal borides, carbides, nitrides and suicides have been disclosed in Japanese Kokai No. JP 04-055,492.

The generation and accumulation of electrostatic charge on film or paper surfaces leads to a variety of problems associated with the manufacture and use of these products. For example, electrostatic charge promotes the attraction of dirt and dust which can lead to these particles being imaged on the film during exposure or printed or projected when these particles are attracted to an already exposed and processed product such as a negative, slide, or motion picture print film. The discharge of accumulated charge during or after the application of the sensitized emulsion layer(s) can produce irregular fog patterns or "static marks" in the emulsion.

The static problems have been aggravated by increases in the sensitivity of new emulsions, increases in coating machine speeds, and increases in post-coating drying efficiency. Electrostatic charge can accumulate during winding and unwinding operations, during transport through the coating machines and during finishing operations such as slitting and spooling.

Electrostatic charge can also be generated during the use of the finished photographic film product. In an automatic camera, the winding of roll film in an out of the film cartridge, especially in a low relative humidity environment, can result in static charging. Similarly, high speed automated film processing can result in static charge generation. Sheet films (e.g., x-ray films) are especially susceptible to static charging during removal from light-tight packaging.

The use of conductive or antistatic layers on photographic products has greatly minimized many of these abovementioned problems associated with electrostatic charge. However, only very recently has it become recognized that the use of a conductive layer can actually exacerbate some static-related problems. When an electrostatic charge is generated on an insulating surface which overlies a buried conductive layers or is on the side of the film opposite to a conductive layer, the conductive layer is unable to dissipate this surface charge. Instead, the conductive layer can "image" the charge by polar charge formation (that is, the conductive layer is able to draw up an equal, but, opposite charge to that on the surface layer). The formation of this image charge or polar charge within the conductive layer effectively collapses the external field generated by the surface charge so that the field becomes internalized within the film. The presence of an external field could otherwise attract airborne dirt and dust particles to the film surface which can lead to several problems already discussed. In this case then, the presence of the conductive layer and the formation of polar charge helps to eliminate a static-related problem, namely dirt and dust attraction. However, an unwanted situation arises from this internal electric field as explained herein below.

A typical photographic product is provided with an insulating, image forming layer on its front surface and a conductive layer on its back surface. During conveyance, the image forming layer may develop a positive electrostatic charge as a result of contact with dissimilar materials such as rollers or other surfaces. The conductive layer then forms an image charge so that the electric field is internalized within the imaging element. This can lead to a variety of film sticking problems when the image charge within the conductive layer on one side of the film couples to the (opposite sign) surface charge on the other side of an adjacent lap of film within a roll or on another sheet of film that it is in contact with. An electrostatic attractive force is generated between these two oppositely charged sides of the film. This force of attraction increases as the distance between the two films is decreased and results in the sticking together of sheets of film or alternatively two adjacent laps of film. Examples where this film sticking has been observed include sheet films such as graphic arts films, microfiche, and x-ray films that contain a conductive layer whose conductive properties survive film processing. Such films become charged as a result of contact with rollers during film processing and can cause jams in the film processor or difficulties in handling the films after processing.

For motion picture print films containing a conductive layer such as those described in U.S. Pat. No. 5,679,505, film sticking may cause jams in film projectors employing endless loop platter systems such as those described in U.S. Pat. Nos. 4,186,891, 4,208,018, and others. Such problems of film sticking in such an endless loop platter system is described in detail in U.S. Pat. No. 6,140,030, wherein it is explained how multiple laps of film may be pulled simultaneously from the core of the film roll and become jammed in the platter system potentially damaging the projector system, the film, or both. Such a problem in motion picture print films is often referred to as "brainwrap" as it is manifested in wrapping multiple layers of film around a central component known as the "brain" in the projector platter.

Increasing the resistivity (or decreasing the conductivity) of the antistatic layer contained on the photographic element can reduce the tendency for the above sticking problems. However, by increasing the resistivity of the conductive layer one may also significantly reduce overall antistatic protection provided by the conductive layer. In particular, the layer may not be sufficiently conductive to prevent static marking of the film during high speed finishing operations such as film slitting, chopping, or perforating. Although it may be possible to optimize the resistivity of the film so that static protection in finishing operations is provided while film sticking such as brainwrap is eliminated by opting for an antistat that provides conductivity only before processing and not after processing. This is typically the case with most antistats, which are not electronic in nature. However, such films will be prone to dirt attraction after processing and can be considered as inferior products. Post processing dirt attraction is a particularly serious problem for motion picture print films, as even small specs of dirt on a print film gets magnified as noticeable defects when projected on a movie screen.

In U.S. Pat. No. 6,140,030, it is proposed that through the use of two conductive layers coated on a photographic element one can achieve static protection before processing and avoid print sticking after processing.

However, the control of conductivity before and after processing is still a challenging problem in the photographic industry. There is a need to develop antistatic layers for photographic products wherein the antistatic layer provides low surface resistivity before processing to ensure static protection during sensitizing, conveyance and finishing operations but provides high surface resistivity after processing to avoid print sticking such as brain wrap observed with print films, without becoming too insulating so that problems such as post-processing dirt attraction, etc. are not encountered.

PROBLEM TO BE SOLVED BY THE INVENTION

There is a need to develop antistatic layers for photographic products wherein the antistatic layer provides low surface resistivity before wet chemical processing but high surface resistivity, without becoming completely insulating, after wet chemical processing.

SUMMARY OF THE INVENTION

It is an object of the invention to provide a method to effectively control conductivity of photographic elements.

It is another object to provide an antistatic layer for photographic elements with low surface electrical resistivity before wet chemical processing. It is a further object to provide surface electrical resistivity ≧10 log ohm/sq. for the antistatic layer after wet processing.

It is an even further object not to render the antistatic layer completely insulating after wet processing by maintaining electrical resistivity <13 log ohms/sq. after wet processing.

These and other objects of the invention are accomplished by a method of conductivity control comprising providing a photographic element having a lower surface antistatic layer comprising polyether polymeric antistat, imaging said photographic element, processing said photographic element in aqueous processing solutions, and recovering said developed photographic element, wherein the lower surface resistivity of said photographic element attains a value ≧10 log ohm/sq. but <13 log ohms/sq. after processing.

ADVANTAGEOUS EFFECT OF THE INVENTION

The invention provides a method for effective control of conductivity of photographic elements. Through this method a photographic element is afforded an antistatic layer of low surface electrical resistivity prior to wet processing, which ensures static protection during sensitizing, conveyance and finishing operations. The invention also allows for a surface resistivity ≧10 log ohm/sq. for the antistatic layer after processing, which eliminates post-processing sticking problems, such as those found in motion picture films, due to coupling of image charges between the imaging side and the antistatic back side with low surface resistivity. The invention, additionally allows for a post-processing surface resistivity of <13 log ohms/sq. which provides post-processing static protection against problems such as dirt attraction.

DETAILED DESCRIPTION OF THE INVENTION

The invention has numerous advantages. The invention provides low surface electrical resistivity to a photographic element before processing. Thus, it can provide static protection during support formation, sensitizing, conveyance, etc. throughout the life of the photographic product until development.

Additionally, the photographic product of the invention acquires a resistivity of ≧10 log ohms/sq. after processing. This desirable characteristic protects the product from post-processing film sticking such as brain-wraps found in motion picture films in endless loop platter systems during projection, due to coupling of image charges between the imaging side and the antistatic back side with low surface resistivity.

Moreover, the present invention achieves such a balanced resistivity control without completely losing electrical conductivity after development, by maintaining a post-processing resistitivity of <13 log ohms/sq. and thus ensures minimized dirt attraction to the film during handling and end-use. This highly desirable post-processing electrical characteristic of the photographic support of the invention is completely unexpected. No specific theory, as to the mechanism of this characteristic, is apparent at this time.

Dirt attraction to processed film is a serious problem for both ordinary negatives and motion picture films. Dirt on negatives can get printed on images such as photographs causing consumer dissatisfaction. In motion picture films, even small specks of dirt can create noticeable defects when magnified and projected on a large screen. In the motion picture industry it is also common to transfer either the color negative film information or a positive print film information into a video signal using a telecine transfer device for subsequent use in television. Telecine devices scan each negative or positive film frame in order to convert the silver-halide image into a video image. Any attracted dirt on the original motion picture film can get scanned and incorporated in the video signal as a defect. Usually such defects need to be painstakingly removed frame-by-frame using digital methods to ensure a defect-free product. Obviously, such a process adds to the cost and is highly undesirable. The invention through its post-processing conductivity minimizes such dirt-related problems offering a superior product. These and other advantages of the invention will be apparent from the detailed description herein below.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image.

The photographic product of the invention comprises at least one layer comprising polyether polymeric antistat. Polyether based polymeric antistats are essentially materials containing polyalkoxylated compounds, which are well known in the art for their excellent melt-processabilty while retaining their antistatic property and overall physical performance. These materials can include various polymeric substances containing polyether blocks such as polyethylene oxides, polypropylene oxides, polybutylene oxides, polytetramethylene oxides, polyoxyalkylene glycols such as polyoxyethylene glycol, polyoxypropylene glycol, polyoxytetramethylene glycol, the reaction products of polyalkoxylates with fatty -acids, the reaction products of polyalkoxylates with fatty alcohols, the reaction products of polyalkoxylates with fatty acid esters of polyhydroxyl alcohols (for instance polyalkoxylate reaction products of fatty acids, of fatty glycols, of fatty sorbitols, of fatty sorbitans, and of fatty alcohols), or, interpolymers and/or mixtures thereof. The polyether chains in the suitable polyalkoxylated compounds are of the formula $(—OC_xH_{2x}—)_n$ wherein x is from 2 to about 8, wherein the alkyl group is straight or branched, and wherein n is from 2 to about 1000. It is believed that ionic conduction along the polyether chains makes these polymers inherently dissipative, yielding surface resistivities in the range $10^8$–$10^{13}$ ohm/square. For the purpose of this invention any polyalkoxylated compounds containing oligomer, homopolymer, interpolymer and/or mixtures thereof can suitably be used as component A in this invention. However, preferred examples of such polyether polymeric antistatic materials are: those comprising polyamide blocks and polyether block(s), e.g;, as disclosed in U.S. Pat. Nos. 4,331,786, 4,115,475, 4,195,015, 4,839,441, 4,864,014, 4,230,838 and 4,332,920 and product literature for Pebax supplied by Elf Atochem, polyetheresteramides, e.g., as disclosed in U.S. Pat. Nos. 5,604,284; 5,652,326; 5,886,098, and thermoplastic polyurethanes containing a polyalkylene glycol moiety, e.g., as disclosed in U.S. Pat. Nos. 5,159,053; 5,863,466, with the content of all of the aforementioned literature incorporated herein by reference. Most preferred polyether polymeric antistats are those comprising polyamide blocks and polyether block(s).

Polymers comprising polyamide blocks and polyether block(s) result from the copolycondensation of polyamide sequences containing reactive ends with polyether sequences containing reactive ends, such as, inter alia: 1) Polyamide sequences containing diamine chain ends with polyoxylakylene sequences containing dicarboxyl chain ends, 2) Polyamide sequences containing dicarboxyl chain ends with polyoxyalkylene sequences containing diamine chain ends obtained by cyanoethylation and hydrogenation of alpha.,.omega-dihydroxylated aliphatic polyoxylakylene sequences known as polyetherdiols, 3) Polyamide sequences containing dicarboxyl chain ends with polyetherdiols, the products obtained being, in this specific case, polyetheresteramides.

The polyamide sequences containing dicarboxyl chain ends result, for example, from the condensation of .alpha., .omega.-aminocarboxylic acids from lactams or of dicarboxylic acids and diamines in the presence of a chain-limiting dicarboxylic acid. The polyamide blocks are advantageously formed from polyamide-6/12.

The number-average molecular mass or weight Mn of the polyamide sequences is between 300 and 15,000 and preferably between 600 and 5,000. The Mn of the polyether sequences is between 100 and 6,000 and preferably between 200 and 3,000.

The polymers containing polyamide blocks and polyether blocks can also comprise units distributed randomly. These polymers can be prepared by the simultaneous reaction of the polyether and the precursors of the polyamide blocks.

For example, polyetherdiol, a lactam (or an alpha., .omega.-amino acid) and a chain-limiting diacid can be reacted in the presence of a small amount of water. A polymer is obtained having essentially polyether blocks and polyamide blocks of highly variable length but also the various reactants, which have reacted randomly, distributed statistically along the polymer chain.

These polymers contain polyamide blocks and polyether blocks, whether they originate from the copolycondensation of polyamide and polyether sequences prepared beforehand or from a single-stage reaction, exhibit, for example, Shore D hardnesses which can be between 20 and 75 and advantageously between 30 and 70 and an intrinsic viscosity between 0.8 and 2.5, measured in metacresol at 25° C.

Whether the polyether blocks derive from polyethylene glycol, from polypropylene glycol or from polytetramethylene glycol, they are either used as they are and copolycondensed with polyamide blocks containing carboxyl ends or they are aminated in order to be converted to polyetherdiamines and condensed with polyamide blocks containing carboxyl ends. They can also be mixed with polyamide precursors and a chain limiter in order to prepare polymers containing polyamide blocks and polyether blocks having units distributed statistically.

The polyether can be, for example, a polyethylene glycol (PEG), a polypropylene glycol (PPG) or a polytetramethylene glycol (PTMG). The latter is also known as polytetrahydrofuran (PTHF).

Whether the polyether blocks are introduced into the chain of the polymer containing polyamide blocks and polyether blocks in the form of diols or diamines, they are known for simplicity as PEG blocks or PPG blocks or alternatively PTMG blocks. It would not be departing from the scope of the invention if the polyether blocks contained different units, such as units derived from ethylene glycol, from propylene glycol or alternatively from tetramethylene glycol.

The polyamide blocks typically comprise condensation product of: one or a number of amino acids, such as aminocaproic, 7-aminoheptanoic, 11-aminoundecanoic and 12-aminododecanoic acids, or one or a number of lactams, such as caprolactam, oenantholactam and lauryllactam; one or a number of salts or mixtures of diamines, such as hexamethylenediamine,dodecamethylenediamine, metaxylylenediamine, bis-(p-aminocyclohexyl)methane and trimethylhexamethylene-diamine, with diacids, such as isophthalic, terephthalic, adipic, azelaic, suberic, sebacic and dodecanedicarboxylic acids; or mixtures of some of these monomers, which result in copolyamides, for example polyamide-6/12 (or nylon-6/12) by condensation of caprolactam and lauryllactam. Polyamide mixtures can be used.

Preferably, the polymer having polyamide blocks and polyether blocks comprises a single type of block. Advantageously, polymers having polyamide-12 blocks and PEG blocks, and polymers having polyamide-6 blocks and PEG blocks are employed. One can however also employ blends of polymers having polyamide blocks and polyether blocks.

Polymers containing polyamide blocks and polyether blocks particularly useful for this invention are described in U.S. Pat. Nos. 4,331,786; 4,115,475; 4,195,015; 4,839,441; 4,864,0143; 4,230,838 and 4,332,920. Such polymers include products such as Pebax, available from Elf Atochem or similar materials. These types of polyether antistatic polymers have been shown to be fairly thermally stable and readily processable in the melt state in their neat form or in blends with other polymeric materials.

The antistat layer of the invention may preferably comprise thermally processable onium salts for higher conductivity. These salts can be chosen to be any compound with an onium moiety, such as ammonium, phosphonium, arsonium, stibonium, bismuthonium, oxonium, sulfonium, selenonium, telluronium, fluronium, chloronium, bromonium, iodonium, etc., which can be thermally processed, such as melt-blended, melt-compounded, melt-extruded, etc. at temperatures above 100° C., without thermal degradation or decomposition. Particularly suitable thermally processable onium salts are those used as charge control agents in toners and developers in the photocopier business, such as those disclosed in U.S. Pat. Nos. 6,027,847; 5,616,444; 5,604,069; 5,582,946; 5,561,020; 5,547,803; 5,516,616; 5,512,407; 5,508,140; 5,4917044; 5,464,719; 5,459,006; 5,198,320; 5,194,472; 5,069,994; 5,051,330; 4,855,396; 4,837,394; 4,837,393; 4,837,392; 4,837,391; 4,834,921; 4,834,920; 4,496,643; 4,806,284; 4,806,283; 4,803,017; 4,789,614; 4,490,455; 4,394,430; 4,338,390; 4,139,483; and references therein and incorporated in their entirety herein below. Onium salts most suitable for this invention are those selected from the group consisting of ammonium, phosphonium, arsonium and sulfonium salts.

The weight ratio of the polyether polymer: thermally processable onium salt in the antistatic layer of the invention can vary between 100:0 and 10:90, and preferably between 99:1 and 75:25 and more preferably between 95:5 and 85:15.

The antistatic layer of the invention may also comprise a binder polymer, which can provide additional desirable characteristics to the web, such as strength, stretchability, adhesion, barrier properties, low cost, etc. Such a binder polymer can be any thermoplastic polymer known in the art. Suitable classes of thermoplastic polymers preferred for this invention can include polymers of alpha-beta unsaturated monomers, polyesters, polyamides, polycarbonates, cellulosic esters, polyvinyl resins, polysulfonamides, polyethers, polyimides, polyurethanes, polyphenylenesulfides, polytetrafluoroethylene, polyacetals, polysulfonates, polyolefins, polyester ionomers, and polyolefin ionomers. Interpolymers and/or mixtures of these polymers can also be used.

Illustrative of polymers of alpha-beta unsaturated monomers, which are suitable for use in this invention include polymers of ethylene, propylene, hexene, butene, octene, vinylalcohol, acrylonitrile, vinylidene halide, salts of acrylic acid, salts of methacrylic acid, tetrafluoroethylene, chlorotrifluoroethylene, vinyl chloride, styrene and the like. Interpolymers and/or mixtures of these aforementioned polymers can also be used in the present invention. Most preferred polymers from this category include polypropylenes and polystyrenes together with their interpolymers and/or mixtures, because of their cost and mechanical properties.

Illustrative polyesters which are suitable for use in this invention can be amorphous or crystalline polyesters including those which are derived from the condensation of aromatic, cycloaliphatic, and aliphatic diols with aliphatic, aromatic and cycloaliphatic dicarboxylic acids and may be cycloaliphatic, aliphatic or aromatic polyesters. Exemplary of useful cycloaliphatic, aliphatic and aromatic polyesters which can be utilized in the practice of their invention are poly(ethylene terephthalate), poly(cyclohexlenedimethylene terephthalate) poly(ethylene dodecate), poly(butylene terephthalate), poly(ethylene naphthalate), poly(ethylene(2,7-naphthalate)), poly(methaphenylene isophthalate), poly(glycolic acid), poly(ethylene succinate), poly(ethylene adipate), poly(ethylene sebacate), poly(decamethylene azelate), poly(ethylene sebacate), poly(decamethylene adipate), poly(decamethylene sebacate), poly(dimethylpropiolactone), poly(parahydroxybenzoate), poly(ethylene oxybenzoate), poly(ethylene isophthalate), poly(tetramethylene terephthalate, poly(hexamethylene terephthalate), poly(decamethylene terephthalate), poly(1,4-cyclohexane dimethylene terephthalate) (trans), poly(ethylene 1,5-naphthalate), poly(ethylene 2,6-naphthalate), poly(1,4-cyclohexylene dimethylene terephthalate) (cis), and poly(1,4-cyclohexylene dimethylene terephthalate) (trans), poly(1,4 cyclohexylene dimethylene terephthalate) with different amounts of glycol and 1,4 cyclohexanedimethanol.

Polyester compounds prepared from the condensation of a diol and an aromatic dicarboxylic acid is preferred for use in this invention. Illustrative of such useful aromatic carboxylic acids are terephthalic acid, isophthalic acid and a o-phthalic acid, 1,3-napthalenedicarboxylic acid, 1,4 napthalenedicarboxylic acid, 2,6-napthalenedicarboxylic acid, 2,7-napthalenedicarboxylic acid, 4,4'- diphenyldicarboxylic acid, 4,4'-diphenysulfphone-dicarboxylic acid, 1,1,3-trimethyl-5-carboxy-3-(p-carboxyphenyl)-idane, diphenyl ether 4,4'-dicarboxylic acid, bis-p(carboxy-phenyl) methane and the like. Of the aforementioned aromatic dicarboxylic acids, those based on a benzene ring (such as terephthalic acid, isophthalic acid, orthophthalic acid) are preferred for use in the practice of this invention. Amongst these preferred acid precursors, terephthalic acid is particularly preferred acid precursor. Also preferred are amorphous polyesters such as poly(1,4 cyclohexylene dimethylene terephthalate) with different amounts of glycol and 1,4 cyclohexanedimethanol and copolyesters prepared from the condensation of various proportions of terephthalic acid and isophthalic acid with ethylene glycol and 1,4 cyclohexane dimethanol. Examples of such polyesters are products like PETG 6763 and PCTG 5445 available from Eastman Chemical Company.

Preferred polyesters for use in the practice of this invention include poly(ethylene terephthalate), poly(butylene terephthalate), poly(1,4-cyclohexylene dimethylene terephthalate), poly(ethylene naphthalate), poly(1,4 cyclohexylene dimethylene terephthalate) with different amounts of glycol and 1,4 cyclohexanedimethanol as well as interpolymers and/or mixtures thereof.

Illustrative of polyamides which are suitable for use in this invention include synthetic linear polycarbonamides characterized by the presence of recurring carbonamide groups as an integral part of the polymer chain, which are separated from one another by at least two carbon atoms. Polyamides of this type include polymers, generally known in the art as nylons, obtained from diamines and dibasic acids having the recurring unit represented by the general formula:

$$—NHCOR^1COHNR^2—$$

in which $R^1$ is an alkylene group of at least 2 carbon atoms, preferably from about 2 to about 11 or arylene having at least about 6 carbon atoms, preferably about 6 to about 17 carbon atoms; and $R^2$is selected from $R^1$ and aryl groups. Also, included are copolyamides and terpolyamides obtained by known methods, for example, by condensation of hexamethylene diamine and a mixture of dibasic acids consisting of terephthalic acid and adipic acid. Polyamides of the above description are well-known in the art and include, for example, the copolyamide of 30% hexamethylene diammonium isophthalate and 70% hexamethylene diammonium adipate, poly(hexamethylene adipamide) (nylon 6,6),poly (hexamethylene sebacamide) (nylon 6, 10), poly (hexamethylene 15 isophthalamide), poly(hexamethylene terephthalamide), poly(heptamethylene pimelamide) (nylon 7,7), poly(octamethylene suberamide) (nylon 8,8), poly (nonamethylene azelamide) (nylon 9,9) poly (decamethylene azelamide) (nylon 10,9), poly (decamethylene sebacamide) (nylon 10,10), poly(bis(4-amino cyclohexyl)methane-1,10-decane-carboxamide)), poly(m-xylylene adipamide), poly(p-xylene sebacamide), poly(2,2,2-trimethyl hexamethylene terephthalamide), poly (piperazine sebacamide), poly(p-phenylene terephthalamide), poly(metaphenylene isophthalamide) and the like.

Other useful polyamides are those formed by polymerization of amino acids and derivatives thereof, as for example lactams. Illustrative of these useful polyamides are poly(4-aminobutyric acid) (nylon 4), poly(6-aminohexanoic acid) (nylon 6), poly(7-aminoheptanoic acid) (nylon 7), poly(8-aminooctanoic acid) (nylon 8), poly(9-aminononanoic acid) (nylon 9), poly(10-amino-decanoic acid) (nylon 10), poly(11-aminoundecanoic acid) (nylon 11), poly(12-aminododecanoic acid) (nylon 12) and the like.

Most preferred polyamides for use in the practice of this invention include poly(caprolactam), poly(1 2-aminododecanoic acid), poly(hexamethylene adipamide), poly(m-xylylene adipamide), and poly(6-aminohexanoic acid) and interpolymers and/or mixtures thereof.

Illustrative of cellulose esters which are suitable for use in this invention include cellulose nitrate, cellulose triacetate, cellulose diacetate, cellulose acetate propionate, cellulose acetate butyrate, and interpolymers and/or mixtures thereof. Illustrative of a polycarbonate suitable for use in this invention is bisphenol-A polycarbonate. Useful polyvinyl resins include polyvinyl chloride, poly (vinyl acetal) and interpolymers and/or mixtures thereof.

Most preferred binder polymer for the invention is selected from the group consisting of polyethylene, polypropylene, poly(vinylidene halide), poly(vinyl chloride), polystyrene, amorphous or crystalline polyesters such as poly(ethylene terephthalate), poly(ethylene naphthalate) and copolyesters prepared from the condensation of various proportions of terephthalic acid and isophthalic acid with ethylene glycol and 1,4 cyclohexane dimethanol as well as various interpolymers and blends thereof . The weight ratio of the polyether polymer: binder polymer in the layer of the invention can vary between 100:0 to 1:99 but preferably between 90:10 to 10:90, and most preferably between 80:20 and 20:80, to optimize electrical conductivity and mechanical strength.

The web of the present invention may also include other optional components. Such optional components include nucleating agents, fillers, plasticizers, impact modifiers, chain extenders, colorants, lubricants, antistatic agents, pigments such as titanium oxide, zinc oxide, talc, calcium carbonate, barium sulfate, clay, etc., dispersants such as fatty amides, (e.g., stearamide), metallic salts of fatty acids, e.g., zinc stearate, magnesium stearate, calcium stearate, etc., dyes such as ultramarine blue, cobalt violet, etc., antioxidants, fluorescent whiteners, ultraviolet absorbers, fire retardants, matte particles or roughening agents, such as silica, titanium dioxide, talc, barium sulfate, clay, and alumina, cross linking agents, voiding agents, compatibilizers, adhesion promoting agents and the like. These optional components and appropriate amounts are well known in the art and can be chosen according to need. Of these optional components, compatibilizers, adhesion promoting agents, pigments and particles are most preferred for their utility. Suitable compatibilizers can be any compatibilizer known in the art, which can ensure compatibility between the polyether polymeric antistat and the binder polymer.

The photographic support comprising the antistatic layer can comprise any number of other layers according to need. The multiplicity of layers may include any number of auxiliary layers such as antistatic layers, backmark retention layers, tie layers or adhesion promoting layers, abrasion resistant layers, conveyance layers, barrier layers, splice providing layers, UV absorption layers, antihalation layers, optical effect providing layers, waterproofing layers, fragrance providing layers, adhesive layers, imaging layers and the like.

The web comprising the antistatic layer can be formed by any method known in the art such as those involving extrusion, coextrusion, casting, orientation, heat setting, lamination, etc. It is preferred that the support of the invention is an oriented sheet formed by any suitable method known in the art such as by a flat sheet process or a bubble or tubular blowing process. The flat sheet process involves extruding or coextruding the materials of the sheet through a slit die and rapidly quenching the extruded or coextruded web upon a chilled casting drum so that the polymeric component(s) of the sheet are cooled rapidly below their solidification temperature without crystallizing. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. The preferred range of stretch ratios in any direction is between 2:1 and 6:1. After the sheet has been stretched, it is heat set by heating to a temperature to improve the crystal structure of the polymers while restraining the sheet against retraction in both stretching directions.

In one embodiment of the invention, the web of the invention comprises an antistatic layer as a skin layer and a solid core layer formed with the following structure:

Solid core containing one or more layers

Skin layer comprising polyether polymeric antistat.

It is to be understood that any number of additional layers can be incorporated on either side or both sides of this web and/or in between the skin layer and the core to fulfill specific needs. The antistatic skin layer comprises a polyether polymeric antistat with or without other addenda described in detail herein above. The core layer comprises any thermoplastic polymer but preferably any of the polymers described herein above as binder polymers. Particularly suitable polymer for the core layer as per the invention is selected from the group consisting of polyethylene, polypropylene, poly(vinylidene halide), poly(vinyl chloride), polystyrene, amorphous or crystalline polyesters such as poly(ethylene terephthalate), poly(ethylene naphthalate) and copolyesters prepared from the condensation of various proportions of terephthalic acid and isophthalic acid with ethylene glycol and 1,4 cyclohexane dimethanol as well as various interpolymers and blends thereof .

The solid core and the antistatic skin layer may be cast by co-extrusion followed by preheating, orientation, heat setting, etc., as a preferred method. The thickness of the preferred biaxially oriented web can vary between 10 $\mu$m to 150 $\mu$m. Below 15 $\mu$m, the web may not be thick enough to minimize any inherent non-planarity in the support and would be more difficult to manufacture. The thickness of the skin layer relative to the total thickness of the web (i.e., core plus skin thickness) can be of any value but is preferred to be between 0. 1% to 25% of the total thickness, and more preferably between 1% and 20% of the total thickness.

The web of the invention may be subjected to any number of coatings and treatments, after extrusion, coextrusion, orientation, etc. or between casting and full orientation, to improve its properties, such as printability, barrier properties, abrasion resistance, heat-sealability, spliceability, adhesion to other supports and/or imaging layers. Examples of such coatings can be acrylic coatings for printability, polyvinylidene halide for heat seal properties, etc. Examples of such treatments can be flame, plasma and corona discharge treatment, to improve printability and adhesion. Further examples of treatments can be calendaring, embossing, patterning, etc. to obtain specific effects on the surface of the web.

The web of the invention can be directly used as a support for the photographic product or can be further incorporated in any other suitable support by lamination, extrusion coating, or any other method known in the art, for application in the photographic product. Typical photographic supports comprise cellulose nitrate, cellulose acetate, poly(vinyl acetate), polystyrene, polyolefins, poly(ethylene terephthalate), poly(ethylene naphthalate), polycarbonate, polyamide, polyimide, glass, natural and synthetic paper, resin-coated paper, voided polymers including polymeric foam, microvoided polymers and microporous materials, fabric, etc., and the web of this invention can be incorporated in any suitable support. The antistatic layer of the invention can be placed anywhere in the photographic support, e.g., on the top side, or the bottom side, or both sides. However, it is preferably placed on the bottom side.

The antistatic layer of the invention provides an electrical resistivity of <12 log ohms/square, preferably <11 log ohms/square and more preferably less than $\leqq$10 log ohms/square before wet photographic processing for development; however, after wet photographic processing the resistivity of the antistatic layer attains a value of $\geqq$10 log ohms/square but <13 log ohms/square.

The photographic elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Usefil gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. Details regarding other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda, conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

In accordance with the present invention, the photographic element described herein above is subjected to wet chemical processing, after light exposure for image capture.

Silver halide photographic materials are processed to generate a silver or dye image via a development stage followed by a series of baths to stabilize and provide permanence to the image. Such baths convert and remove unwanted materials from the coated photographic layers, which would either interfere with the quality of the final image or cause degradation of the image with time. In typical color systems the development stage is followed by a bleach stage to oxidize the developed silver to a form, which can be dissolved by a fixing agent in the same or a separate bath. Such silver removal stages are then followed by a washing stage using water, or other wash solution, or a stabilization stage using a stabilizer solution. Such stages remove residual chemicals and may also include conversion reactions between stabilizer solution components and materials within the coated layers. These stages are required to provide the required degree of permanence to the final image. Finally the photographic element is dried for end use by the customer.

Depending on the application, the photographic element of the present invention can be subjected to any suitable aqueous processing, such as C-41 processing for consumer films, a typical motion picture film processing or photographic paper processing, to obtain the desirable but unexpected post-processing electrical characteristics.

The following examples illustrate the practice of this invention. They are not intended to be exhaustive of all possible variations of the invention. Parts and percentages are by weight unless otherwise indicated.

EXAMPLES

Examples of biaxially oriented webs of this invention are prepared with a skin layer comprising a polyether polymeric antistat, on a solid core of polyester (PET) as schematically shown below:

Solid core of polyester

Skin layer comprising polyether polymeric antistat and ammonium salt.

The polyether polymeric antistat of the skin layer is chosen to be a polyether-block-copolyamide, Pebax MV 1074 or Pebax MH 1657, supplied by Elf Atochem. Pebax MV 1074 is a polyamide- 12 based polymer with a PEG ether segment and Pebax MH 1657 is a polyamide-6 based polymer with a PEG ether segment. The skin layer additionally comprises an ammonium salt, namely benzyldimethyloctadecylammonium 3-nitrobenzenesulfonate at a level of 5% by weight of the Pebax and ammonium salt mixture. In some examples, the skin layer further comprises an amorphous copolyester binder PETG 6763, supplied by Eastman Chemicals Company.

The material of the skin layer is pre-compounded and pelletized in a co-rotating twin screw compounder. The pellets of the precompounded material for the skin and the material for the core, are dried at 65° C. and fed by two plasticating screw extruders into a co-extrusion die manifold to produce a two-layered melt stream, which is rapidly quenched on a chill roll after issuing from the die. By regulating the throughputs of the extruders it is possible to adjust the thickness ratio of the skin layer and the core in the cast sheet. In these cast sheets, the core layer thickness is nominally maintained at 750 $\mu$m. The cast sheets are produced by first drafting the sheet at 3.3× in the machine direction followed by tentering at 3.3× in the transverse direction, at a temperature of 100° C. in both stretches.

For resistivity tests, samples are preconditioned at 50% RH (unless otherwise noted) and at 72° F. for at least 24 hours prior to testing. Surface electrical resistivity (SER) of the skin layer is measured with a Keithly Model 616 digital electrometer using a two point DC probe by a method similar to that described in U.S. Pat. No. 2,801,191. SER can be measured before and after the sample has been run though atypical wet chemical processing, such as C-41 processing. For desirable performance, the antistatic skin layer should exhibit SER values <12 log ohms/square, preferably <11 log ohms/square and more preferably $\leqq$10 log ohms/square, before processing. Additionally, the antistatic skin layer should desirably exhibit SER $\geqq$10 log ohms/square but <13 log ohms/square, after wet chemical processing.

Examples 1–6 are prepared and processed in accordance with the present invention. Processing is carried out per C-41 processing chemistry. Details about the composition of these examples and their corresponding SER data, measured pre C-41 processing and post C-41 processing, are listed in Table 1.

TABLE 1

| Sample | Skin composition | Ammonium salt | PETG binder | Core composition PET | Skin thickness | Core thickness | SER Pre-C-41 log ohms/sq. | SER Post-C-41 log ohms/sq. |
|---|---|---|---|---|---|---|---|---|
| | Pebax 1074 | | | | | | | |
| Ex. 1 | 95% | 5% | none | 100% | 10 | 75 | 9.3 | 10.6 |
| Ex. 2 | 95% | 5% | none | 100% | 2 | 75 | 10 | 10.9 |
| Ex. 3 | 95% | 5% | none | 100% | 1 | 75 | 10.4 | 11.4 |
| Ex. 4 | 47.5% | 2.5% | 50% | 100% | 10 | 75 | 9.9 | 10.4 |
| | Pebax 1657 | | | | | | | |
| Ex. 5 | 95% | 5% | none | 100% | 1 | 75 | 10 | 11.4 |
| Ex. 6 | 47.5% | 2.5% | 50% | 100% | 10 | 75 | 9.9 | 10.4 |

It is clear that all samples formed in accordance with this invention provide low surface electrical resistivity before processing to ensure static protection of the photographic element during sensitizing, conveyance, finishing, etc. It is also clear that after processing in accordance with the present invention, the samples attain SER values >10 log ohms/square to minimize post-processing print sticking, such as brainwrap, observed in some photographic products. Furthermore, it is clear that the samples maintain SER values <13 log ohms/square, even after wet chemical processing, to minimize problems such as dirt attraction during end use, demonstrating the high desirability of the products of this invention.

The invention has been described in detail with particular reference to certain preferred embodiments thereof, but it will be understood that variations and modifications can be effected within the spirit and scope of the invention.

What is claimed is:

1. A method of conductivity control comprising providing a photographic element having a lower surface antistatic layer comprising polyether polymeric antistat, imaging said photographic element, processing said photographic element in aqueous development solutions, and recovering said developed photographic element, wherein the lower surface resistivity of said photographic element attains a value of between 10 log ohm/sq. and 13 log ohms/sq. after processing.

2. The method of claim 1 wherein said antistatic layer further comprises a binder polymer.

3. The method of claim 1 wherein said antistatic layer further comprises thermally processable onium salt.

4. The method of claim 1 wherein said photographic element comprises a photographic print material and said lower surface resistivity is less than 13 log ohm/sq. prior to processing and is less than 12 log ohm/sq. after processing.

5. The method of claim 1 wherein said photographic element comprises a photographic film material and said lower surface resistivity is less than 11 log ohm/sq. prior to processing and is less than 12 log ohm/sq. after processing.

6. The method of claim 1 wherein said photographic element is a color print material.

7. The method of claim 1 wherein said photographic element is a color film material.

8. The method of claim 7 further comprising passing said film through the brain of a film projector without brain wrap.

* * * * *